US007561260B2

(12) United States Patent
Samukawa

(10) Patent No.: US 7,561,260 B2
(45) Date of Patent: Jul. 14, 2009

(54) SYSTEM FOR VERIFYING THE ACCURACY OF LENS HOLDER ATTACHMENT, LENS ATTACHMENT STAGE, AND LENS PROCESSING SYSTEM

(75) Inventor: Masahiko Samukawa, Tokyo (JP)

(73) Assignee: Hoya Corporation, Tokyo (JP)

( * ) Notice: Subject to any disclaimer, the term of this patent is extended or adjusted under 35 U.S.C. 154(b) by 236 days.

(21) Appl. No.: 11/806,401

(22) Filed: May 31, 2007

(65) Prior Publication Data

US 2007/0291268 A1 Dec. 20, 2007

(30) Foreign Application Priority Data

Jun. 2, 2006 (JP) ..... 2006-155220

(51) Int. Cl.
*G01B 9/00* (2006.01)
*G01B 11/00* (2006.01)

(52) U.S. Cl. ..... 356/124; 356/244; 356/399

(58) Field of Classification Search ..... 356/124–127, 356/399–401, 244
See application file for complete search history.

(56) References Cited

U.S. PATENT DOCUMENTS 7,189,147 B2 3/2007 Igarashi et al.
2002/0097389 A1 * 7/2002 Daimaru et al. ..... 356/124
2003/0143936 A1 7/2003 Igarashi et al.
2005/0046792 A1 * 3/2005 Ito et al. ..... 351/177

FOREIGN PATENT DOCUMENTS

| | | |
|---|---|---|
| EP | 1 201 360 A2 | 5/2002 |
| JP | A 2001-047347 | 2/2001 |
| JP | A 2001-157956 | 6/2001 |
| JP | A 2002-022598 | 1/2002 |
| WO | WO 00/50200 A | 8/2000 |
| WO | WO 01/62438 A1 | 8/2001 |

* cited by examiner

*Primary Examiner*—Hoa Q Pham
(74) *Attorney, Agent, or Firm*—Oliff & Berridge, PLC

(57) ABSTRACT

A system comprises the step for applying a mark in advance in a reference position in which attachment of a lens holder is anticipated on a convex lens surface of a reference lens; the step for attaching the lens holder to the convex lens surface of the reference lens by using a holder attachment apparatus; and the step for comparing a position in which the lens holder is actually attached and a reference position in which the mark is applied on the lens. A cavity-shaped hole is formed in the holder so that a position of the mark on the reference lens can be observed when the lens holder is attached to the lens. In the comparison step, a toolmaker's microscope is used to observe the mark through the hole in the lens holder from a direction of the convex lens surface of the lens, an actual attachment position of the holder is compared to the reference position of the reference lens, and an attachment accuracy of the holder is verified.

20 Claims, 14 Drawing Sheets

SYSTEM FOR VERIFYING THE ACCURACY OF LENS HOLDER ATTACHMENT, LENS ATTACHMENT STAGE, AND LENS PROCESSING SYSTEM

BACKGROUND OF THE INVENTION

1. Field of the Invention

The present invention relates to a system for verifying the accuracy of lens holder attachment, for verifying the accuracy of attachment of a lens holder attachment apparatus for attaching (blocking) a lens holder to an untreated eyeglass lens or other lens; to a lens attachment stage used in the system for verifying the accuracy of lens holder attachment; and to a lens processing system that includes the abovementioned system for verifying the accuracy of lens holder attachment.

2. Description of the Related Art

In a commonly known method, an untreated eyeglass lens is attached to a lens holder using a lens blocker apparatus (lens holder attachment apparatus), and the untreated eyeglass lens is then edged in this state.

JP-A 2001-47347, JP-A 2001-157956, JP-A 2002-22598, and International Publication WO Pamphlet 2001/62438A1 in particular disclose techniques for monofocal lenses, progressive multifocal lenses, multifocal lenses, and other untreated eyeglass lenses in which a lens holder is automatically attached to the center processing position (optical center position, eyepoint position, geometric center, or other center position) of one of the above-mentioned untreated eyeglass lenses using a lens blocker apparatus (lens holder attachment apparatus) without manual intervention, and the untreated eyeglass lens to which the lens holder is attached is mounted in a cutting machine or a grinding machine for edging.

SUMMARY OF THE INVENTION

However, no method or system has been proposed for verifying the accuracy of attachment when a lens holder is attached to the prescribed position (center processing position, for example) of an untreated eyeglass lens in the lens blocker apparatuses described in the above-mentioned publications.

Consequently, when the attachment to the lens holder in the lens blocker apparatus has low accuracy, processing defects or reduced processing accuracy can easily occur during subsequent edging of the untreated eyeglass lens. Therefore, in some cases, the edged eyeglass lens is rendered defective, and the lens must be discarded.

The present invention was developed in view of the foregoing drawbacks, and an object of the present invention is to provide a system for verifying the accuracy of lens holder attachment, a lens attachment stage used in the system for verifying the accuracy of lens holder attachment, and a lens processing system that includes the system for verifying the accuracy of lens holder attachment, whereby the accuracy with which a lens holder is attached to a lens by a lens holder attachment apparatus can be precisely verified.

The system for verifying accuracy of lens holder attachment according to a first aspect of the present invention comprises a marking step for applying a mark in advance in a reference position in which attachment of a lens holder is anticipated on a convex lens surface of a reference lens when the lens holder is attached to the reference lens; an attachment step for attaching the lens holder to the convex lens surface of the reference lens by using a lens holder attachment apparatus; and a comparison step for comparing a position in which the lens holder is actually attached and a reference position in which the mark is applied on the reference lens; wherein a cavity-shaped hole is formed in the lens holder so that a position of the mark on the reference lens can be observed when the lens holder is attached to the reference lens; and a toolmaker's microscope is used in the comparison step to observe the mark through the cavity-shaped hole in the lens holder from a direction of the convex lens surface of the reference lens, an actual attachment position of the lens holder is compared to the reference position of the reference lens, and an attachment accuracy of the lens holder is verified.

The system for verifying accuracy of lens holder attachment according to a second aspect of the present invention is the system of the first aspect, further comprising a setting step for setting a geometric center of the lens holder so as to coincide with an actual attachment position of the lens holder in the comparison step when the lens holder is attached to the reference lens.

The system for verifying accuracy of lens holder attachment according to a third aspect of the present invention is the system of the second aspect, wherein a lens attachment stage is mounted on a measurement stage of a toolmaker's microscope in the setting step so that a geometric center position of a lens holder coincides with an actual attachment position in the comparison step, and the lens attachment stage is provided with a first hole for retaining the lens holder.

The system for verifying accuracy of lens holder attachment according to a fourth aspect of the present invention is the system of the second or third aspect, wherein the setting step comprises fitting a fixture having a geometric center and an outside diameter that is the same as an outside diameter of the lens holder into the first hole so that a geometric center position of a lens holder retained in the first hole of a lens attachment stage coincides with a center of a field of view of the toolmaker's microscope, and adjusting the toolmaker's microscope so that a geometric center position of the fixture coincides with a center of a field of view of the toolmaker's microscope.

The system for verifying accuracy of lens holder attachment according to a fifth aspect of the present invention is the system of any of the first through fourth aspects, wherein the marking step comprises marking an optical center position of a monofocal lens as a reference position when the reference lens is a monofocal lens.

The system for verifying accuracy of lens holder attachment according to a sixth aspect of the present invention is the system of any of the first through fourth aspects, wherein the marking step comprises marking a center position of two hidden marks on a progressive multifocal lens, or an eyepoint position at a prescribed distance from a center position of the hidden marks as a reference position when the reference lens is a progressive multifocal lens.

The system for verifying accuracy of lens holder attachment according to a seventh aspect of the present invention is the system of any of the first through fourth aspects, wherein the marking step comprises marking a segment top position of a multifocal lens, or an eyepoint position at a prescribed distance from the segment top position as a reference position when the reference lens is a multifocal lens.

The system for verifying accuracy of lens holder attachment according to an eighth aspect of the present invention is the system of any of the first through seventh aspects, further comprising a mark observation step for applying at least two marks for indicating an axis line of the reference lens on both sides of a reference position in a convex lens surface of the reference lens, and observing the marks from a direction of the convex lens surface by using a toolmaker's microscope to verify an attachment accuracy about an axis of a lens holder attached to the convex lens surface of the reference lens.

The lens processing system according to a ninth aspect of the present invention uses the system for verifying accuracy of lens holder attachment according to any of the first through eighth aspects to perform a lens holder attachment step for attaching a lens holder to an untreated eyeglass lens by using the lens holder attachment apparatus, and a grinding/cutting step for performing at least one of grinding and cutting of the untreated eyeglass lens after an attachment accuracy of the lens holder in the lens holder attachment apparatus is verified and the attachment accuracy is confirmed to be satisfactory.

The lens attachment stage according to a tenth aspect of the present invention is a lens attachment stage for attaching the reference lens via a lens holder attached to a convex lens surface of a reference lens, the lens attachment stage comprising a first hole designed to retain the lens holder and provided with the same diameter as an outside diameter of the lens holder, and at least two second holes provided in positions that correspond to marks applied so as to indicate an axis line of the reference lens, wherein the convex lens surface of the reference lens can be observed by a toolmaker's microscope using a lens holder retained by the first hole.

In the invention according to any of the first through seventh aspects, a comparison is made between the position in which the lens holder is actually attached to the convex lens surface of the reference lens, and the mark applied on the convex lens surface of the reference lens in the reference position in which attachment of the lens holder is anticipated. This comparison is performed by using a toolmaker's microscope to observe the mark through the cavity-shaped hole in the lens holder from the direction of the convex lens surface of the reference lens. Accordingly, the accuracy with which the lens holder is actually attached using the lens holder attachment apparatus can be precisely verified without the observation being affected by the optical effects of the reference lens.

In the invention according to the eighth aspect, at least two marks for indicating an axis line that are applied to the convex lens surface of the reference lens are observed from the direction of the convex lens surface of the reference lens by using a toolmaker's microscope, whereby the attachment accuracy about an axis of the lens holder attached to the reference lens is verified. Accordingly, the attachment accuracy about the axis can be precisely verified without the observation being affected by the optical effects of the reference lens.

In the invention according to the ninth aspect, the system for verifying accuracy of lens holder attachment is used to attach a lens holder to an untreated eyeglass lens by using the lens holder attachment apparatus, and perform at least one of grinding and cutting of the untreated eyeglass lens when the attachment accuracy of the lens holder in the lens holder attachment apparatus is satisfactory. Therefore, since an untreated eyeglass lens to which the lens holder is attached with low accuracy is not subjected to at least one of grinding and cutting, it is possible to prevent processing defects or reduced processing accuracy from occurring due to performing at least one of grinding and cutting of such an untreated eyeglass lens.

In the invention according to the tenth aspect, the lens holder is retained by the first hole of the lens attachment stage, and the indication or mark on the convex lens surface of the reference lens attached to the lens holder can be observed from the direction of the convex lens surface by using a toolmaker's microscope. Therefore, the indication or mark may be precisely verified without the observation being affected by the optical effects of the reference lens.

BRIEF DESCRIPTION OF THE DRAWINGS

FIG. 2 shows a state in which a lens holder attached to a reference lens is retained by the lens attachment stage shown in FIG. 1, wherein

FIG. 3 shows the lens attachment stage shown in FIG. 2, wherein

FIG. 7 shows the lens holder in FIGS. 1 and 2, wherein

FIG. 8 shows the blocked state of an untreated eyeglass lens, wherein

FIG. 10 shows a state in which the centering fixture is attached to the lens attachment stage shown in FIG. 9, wherein

KEY TO SYMBOLS

Figure 1:
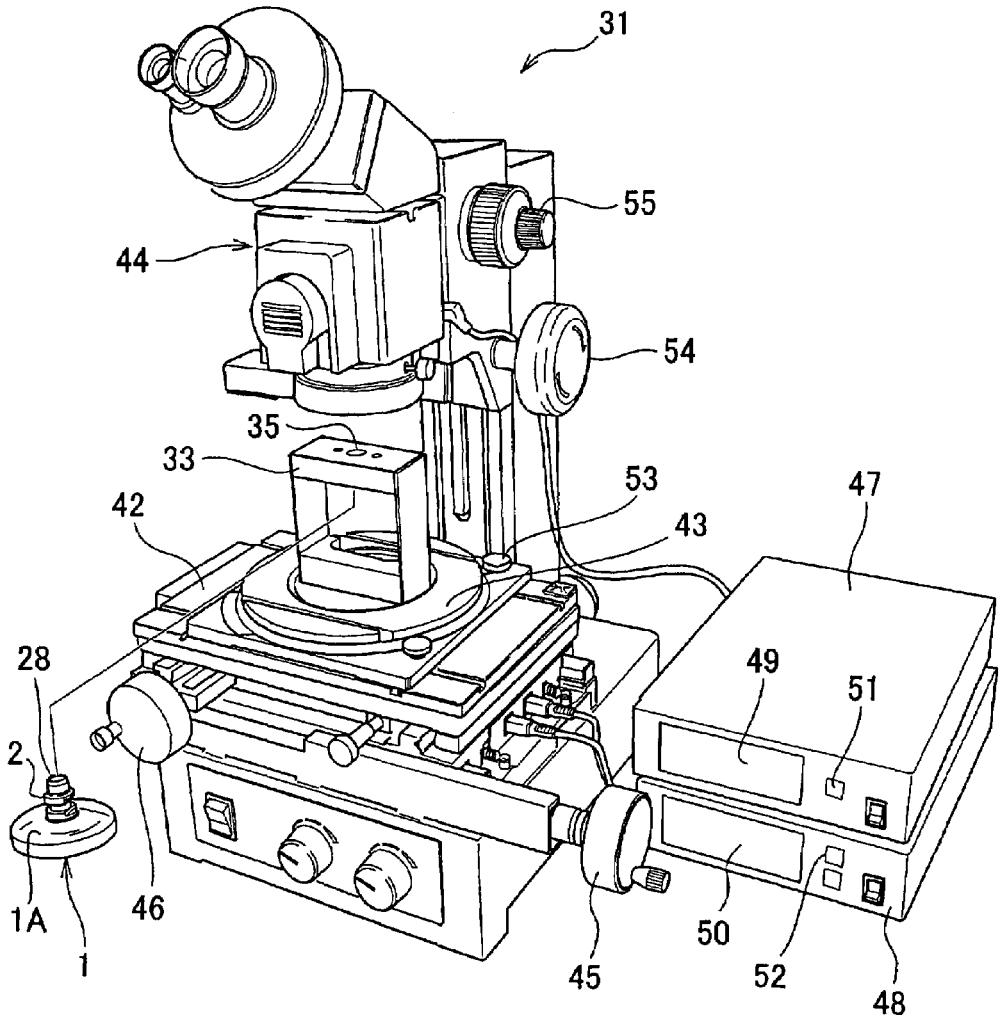
FIG. 1 is a perspective view showing the toolmaker's microscope, the lens attachment stage, and other components in a first embodiment of the system for verifying accuracy of lens holder attachment according to the present invention.

1 reference lens
1A convex lens surface
2 axis line
12, 14 lens holders

19 fitting shaft
28 cavity-shaped hole
29 geometric center
30 field-of-view center
31 toolmaker's microscope
32 centering fixture
33 lens attachment stage
34 mark
35 first hole
36, 37, 38 second holes
60 edging apparatus
100 lens
$A_0$, $B_0$, $C_0$ marks
$A_1$, $A_2$, $B_1$, $B_2$, $C_1$, $C_2$ axis line indicator marks

DESCRIPTION OF THE PREFERRED EMBODIMENTS

Preferred embodiments of the present invention will be described hereinafter based on the accompanying drawings.

Figure 2A:
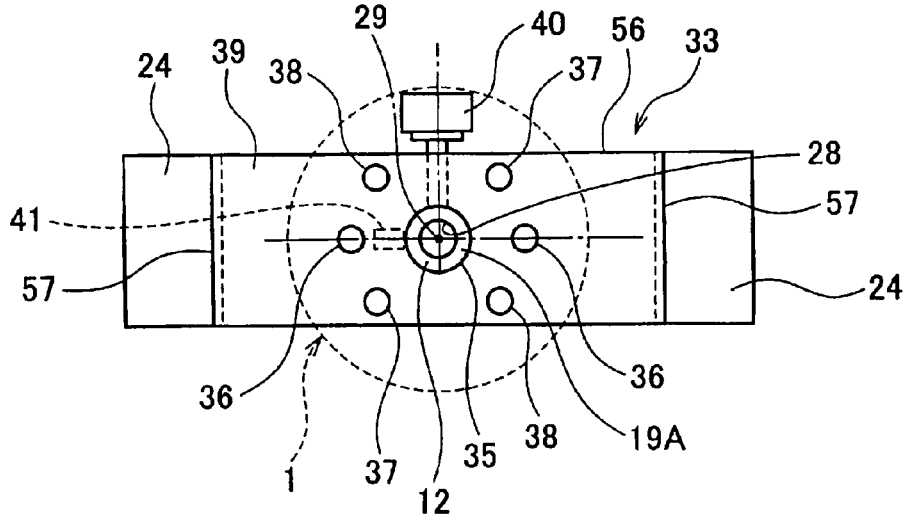
FIG. 2A is a front sectional view.
Figure 2B:
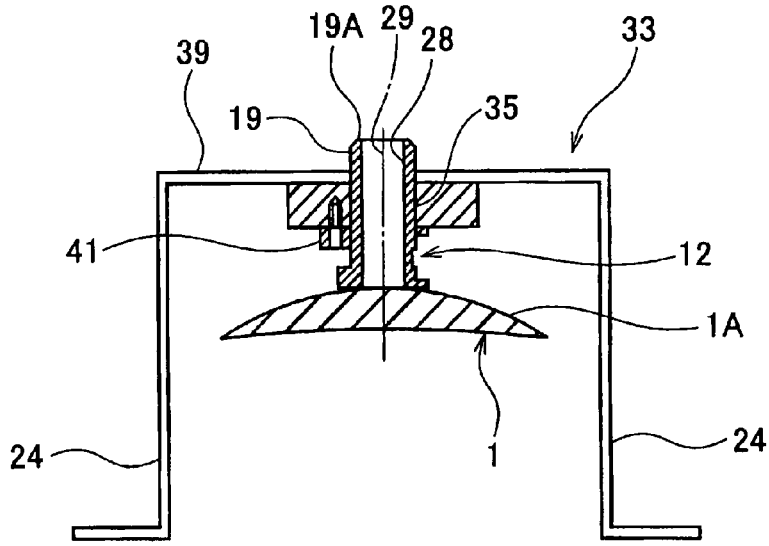
FIG. 2B is a plan view.
Figure 2C:
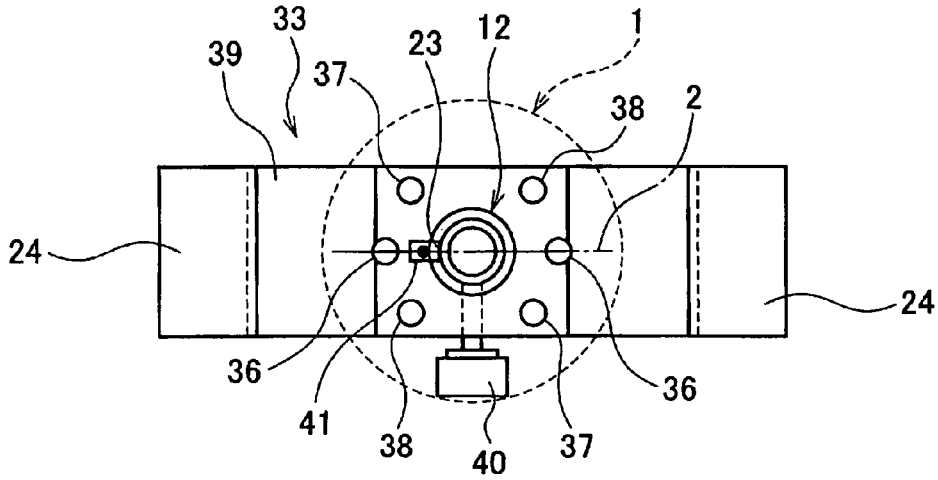
FIG. 2C is a bottom view.
Figure 3B:
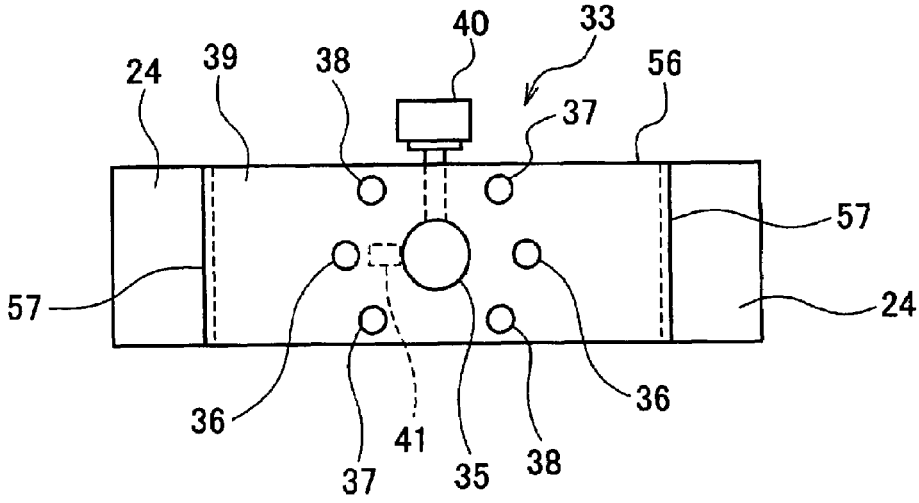
FIG. 3B is a plan view.
Figure 3A:
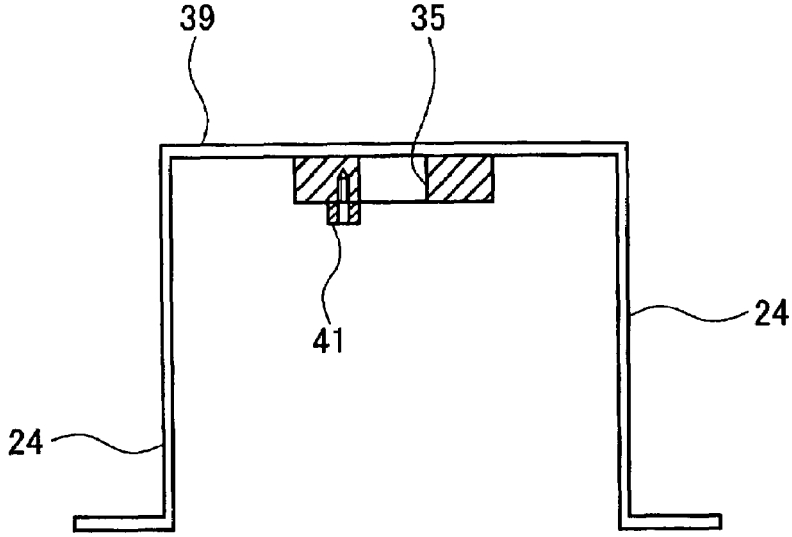
FIG. 3A is a front sectional view.
Figure 3C:
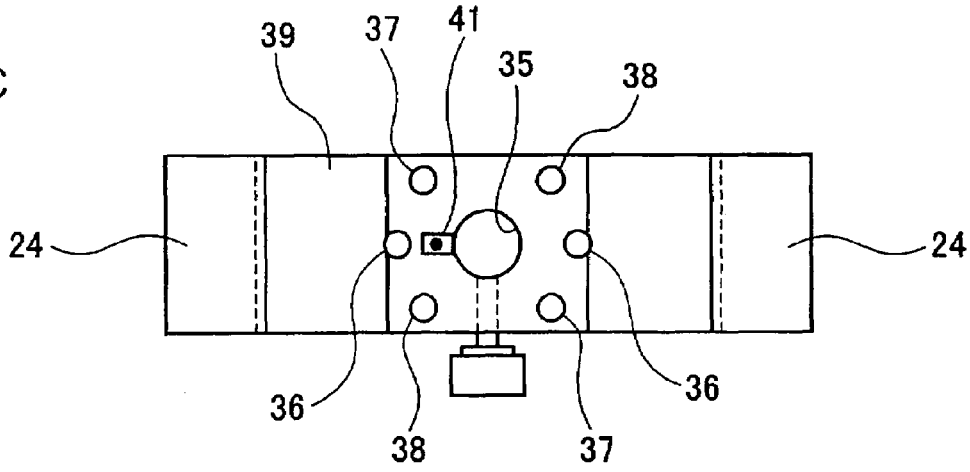
FIG. 3C is a bottom view.

FIG. 1 is a perspective view showing the toolmaker's microscope, the lens attachment stage, and other components in a first embodiment of the system for verifying accuracy of lens holder attachment according to the present invention. FIG. 2 shows a state in which a lens holder attached to a reference lens is retained by the lens attachment stage shown in FIG. 1, wherein FIG. 2A is a front sectional view, FIG. 2B is a plan view, and FIG. 2C is a bottom view. FIG. 3 shows the lens attachment stage shown in FIG. 2, wherein FIG. 3A is a front sectional view, FIG. 3B is a plan view, and FIG. 3C is a bottom view.

Figure 12:
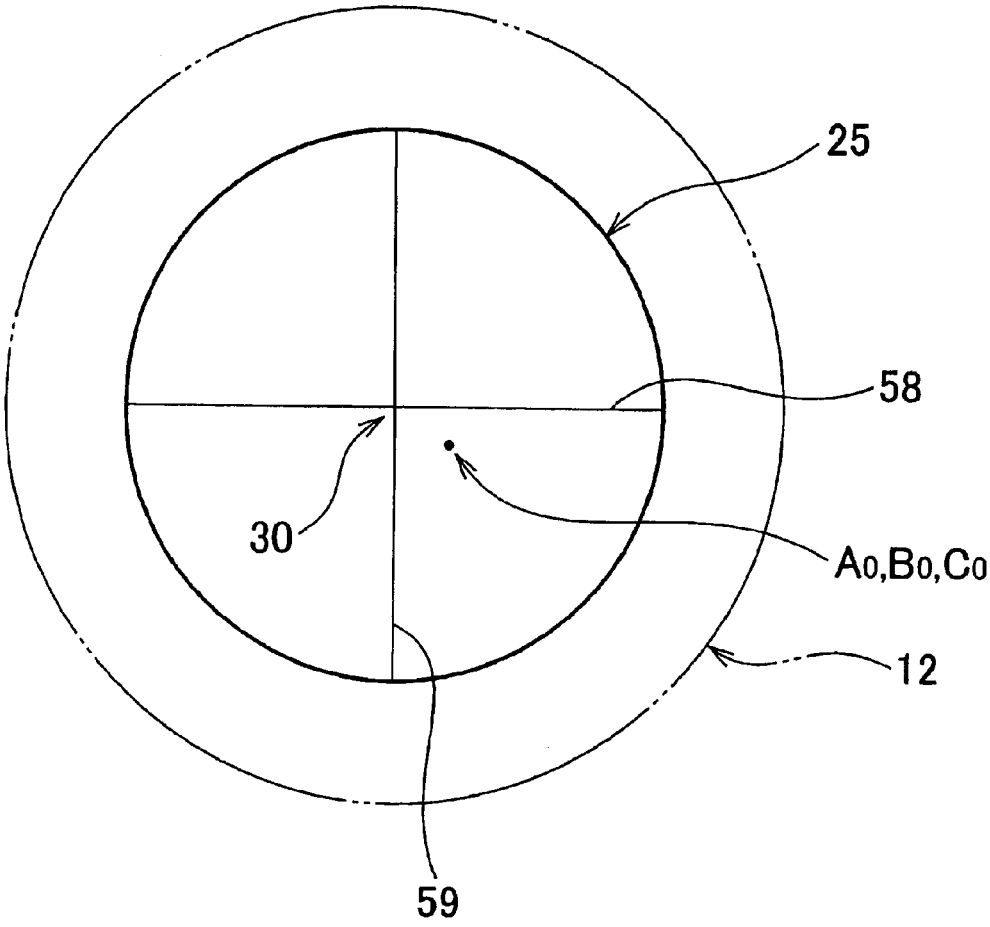
FIG. 12 is a diagram showing the field of view of the toolmaker's microscope in the system for verifying accuracy of lens holder attachment shown in FIG. 1, wherein the center of the field of view, and a mark for indicating the reference position of the reference lens are shown.
Figure 13A:
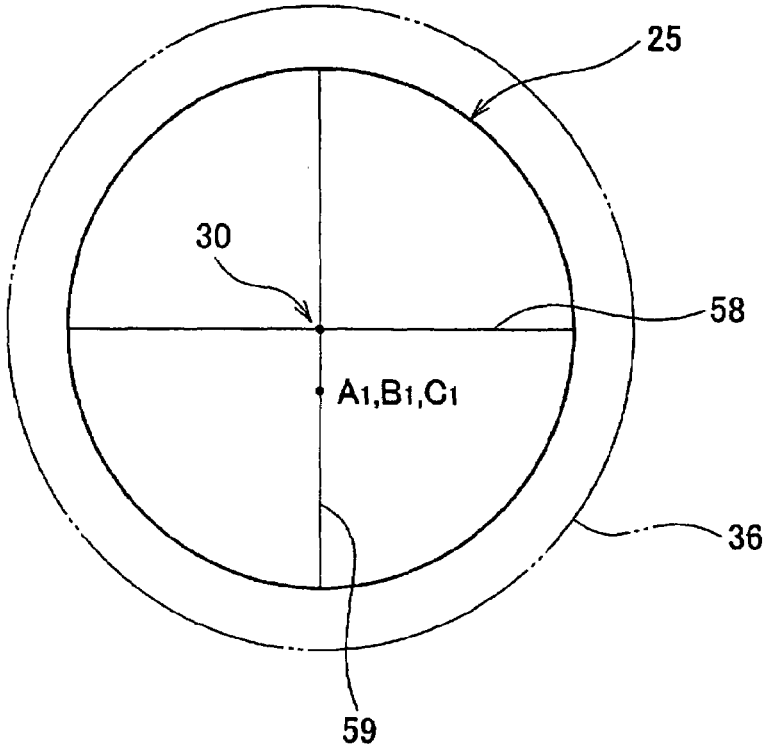
FIG. 13 is a diagram showing the field of view of the toolmaker's microscope in the system for verifying accuracy of lens holder attachment shown in FIG. 1, and also showing the center of the field of view and an axis line indicating mark in the reference lens.
Figure 13B:
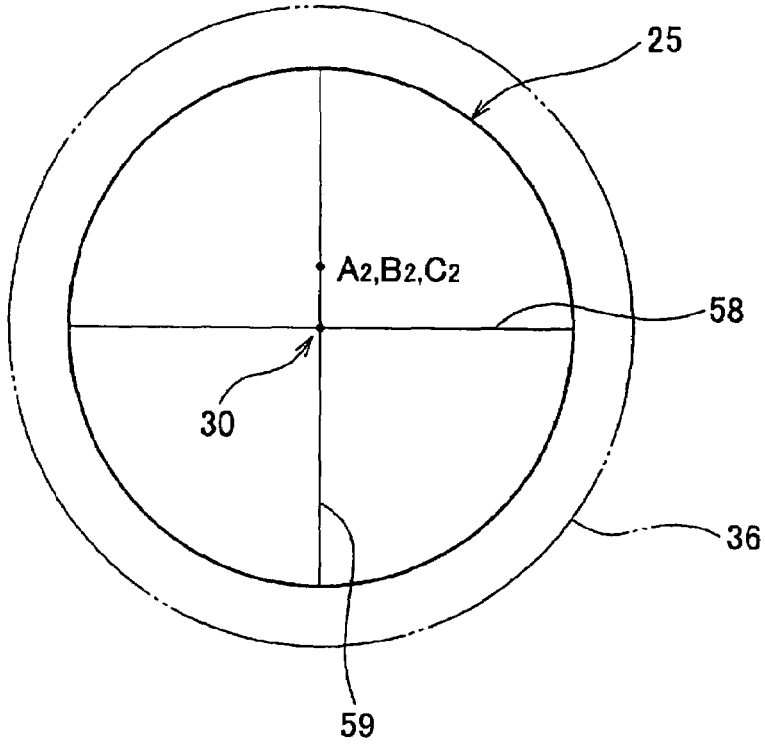

The system for verifying accuracy of lens holder attachment according to the present embodiment uses a lens holder attachment apparatus (i.e., lens blocker apparatus) not shown in the drawings to verify the accuracy with which a lens holder 12 is attached (i.e., blocked) to a reference lens 1, and is composed of a marking step (FIGS. 4 through 6), an attachment step (FIGS. 7 and 8), a setting step (FIGS. 9 through 11), a comparison step (FIGS. 1 through 3, and FIG. 12), and a mark observation step (FIG. 13).

Figure 4A:
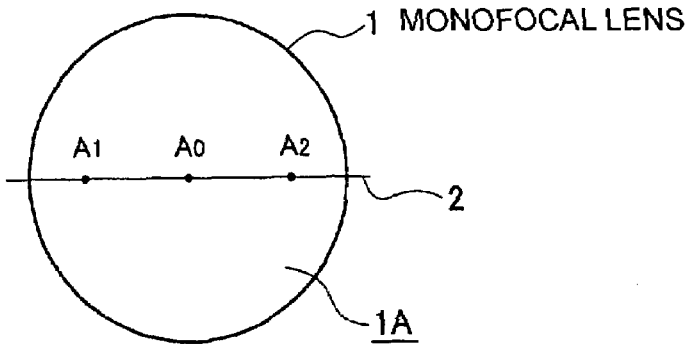
FIG. 4 is a front view of the reference lens that shows marks including mark $A_0$ for indicating the reference position (optical center position), and that shows the method of calculating mark $A_0$ when the reference lens in FIGS. 1 and 2 is a monofocal lens.
Figure 4B:
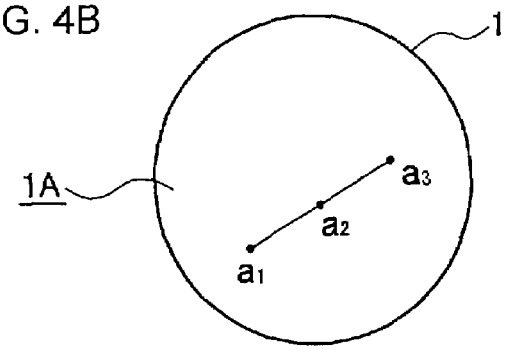
Figure 4C:
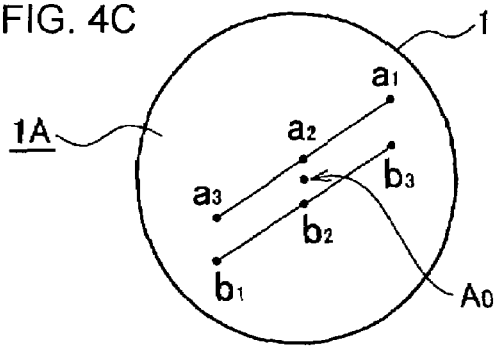
Figure 4D:
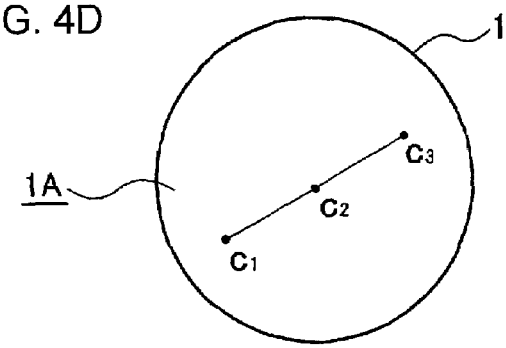
Figure 4E:
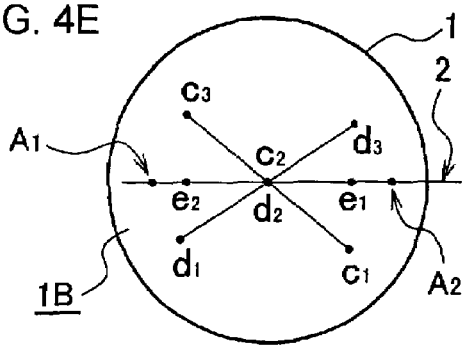
Figure 5:
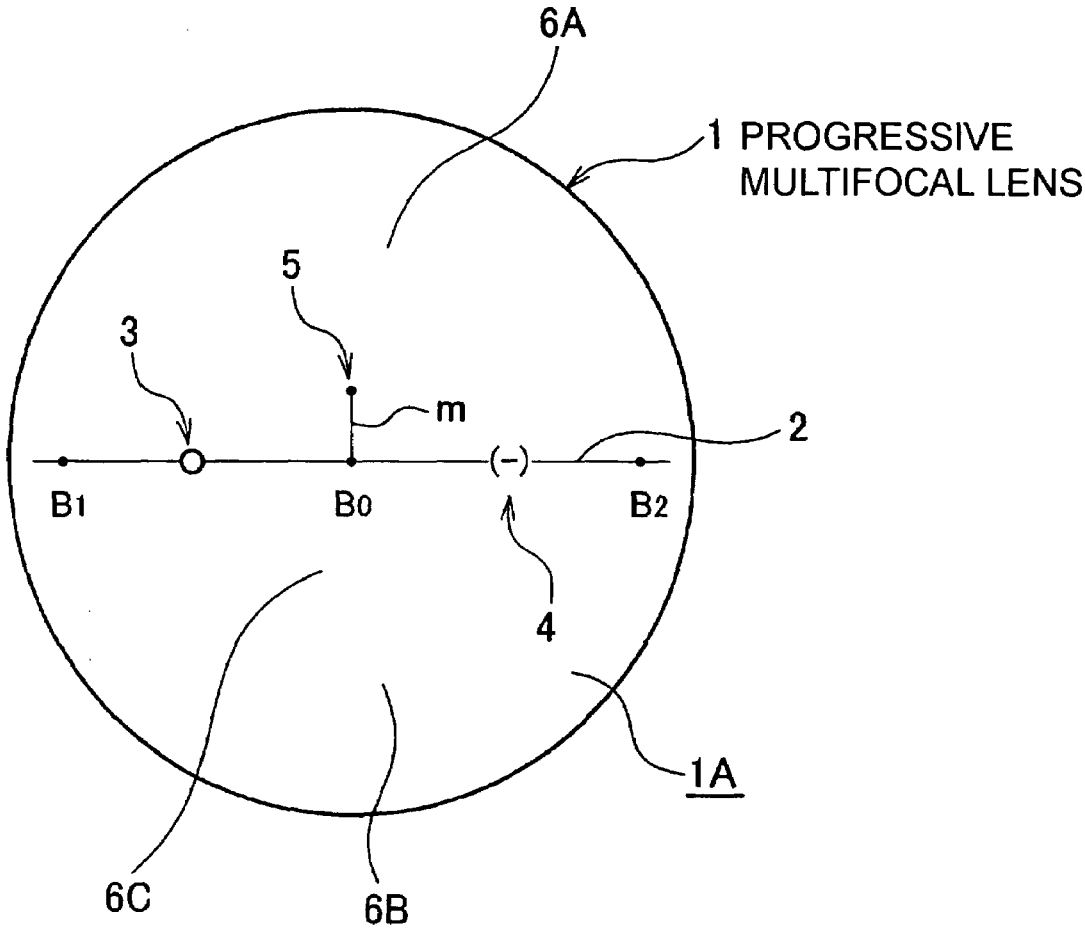
FIG. 5 is a front view of the reference lens that shows marks including mark $B_0$ for indicating the reference position (hidden mark center position, far-vision eyepoint position) when the reference lens in FIGS. 1 and 2 is a progressive multifocal lens.
Figure 6:
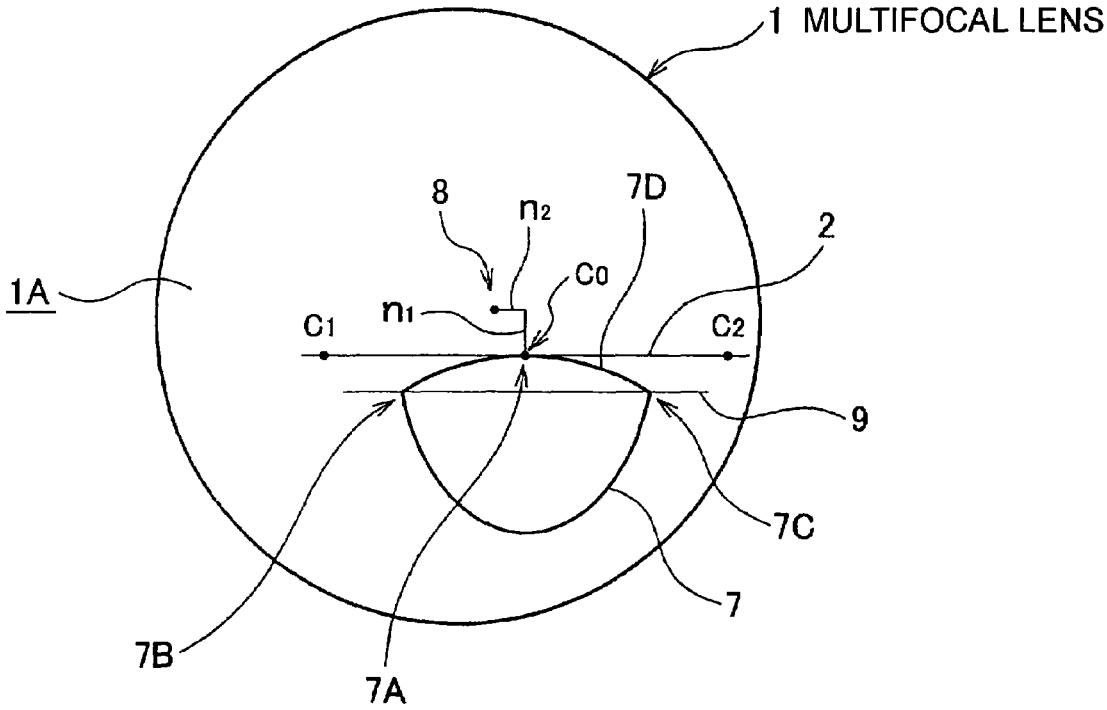
FIG. 6 is a front view of the reference lens that shows marks including mark $C_0$ for indicating the reference position (segment top position, far-vision eyepoint position) when the reference lens in FIGS. 1 and 2 is a multifocal lens.

In the abovementioned marking step as shown in FIGS. 4 through 6, marks $A_0$, $B_0$, and $C_0$ are applied in reference positions in which the lens holder 12 is predicted to be attached on the convex lens surface 1A of the reference lens 1, and axis line indicator marks $A_1$, $A_2$, $B_1$, $B_2$, $C_1$, and $C_2$ are applied on both sides of the reference positions on the convex lens surface 1A. For example, when the reference lens 1 is a monofocal lens, mark $A_0$ is applied to mark the optical center position as a reference position, as shown in FIG. 4A, and at least two axis line indicator marks $A_1$, $A_2$ for indicating an axis line 2 of the reference lens 1 are applied on both sides of mark $A_0$.

The mark $A_0$ described above is applied as follows. First, a lens meter having an imprinting function is used to apply three points a1, a2, a3 to the convex lens surface 1A of the reference lens 1 (FIG. 4B). The reference lens 1 is then rotated 180 degrees about the optical axis, and the lens meter is used to apply three points b1, b2, b3 (FIG. 4C). Using a toolmaker's microscope (e.g., the toolmaker's microscope 31 shown in FIG. 1), the point (center point) positioned at half the distance between the two middle points a2, b2 is calculated as the optical center position, and mark $A_0$ is applied in the optical center position using a router or other stamping tool. The lens meter having an imprinting function referred to herein is described in "Eyeglasses (rev. ed.), Medical Aoi Publications, Jan. 10, 2001, p. 171."

The abovementioned axis line indicator marks $A_1$, $A_2$ are applied as follows. First, the abovementioned mark $A_0$ of the reference lens 1 that was applied as described above is matched to the center of the lens meter. The shaft of the lens meter having an imprinting function is then set to an arbitrary angular axis (e.g., 2 to 3 degrees), and points c1, c2, c3 are applied to the convex lens surface 1A (or concave lens surface 1B) of the reference lens 1. The reference lens 1 is then turned over, the optical center position of the reference lens 1 is matched to the center of the abovementioned lens meter, the same angular axis as previously described is set, and points d1, d2, d3 are applied to the concave lens surface 1B (or convex lens surface 1A) of the reference lens 1.

The center points c2 and d2 then match, and the straight line that links points c1, c2, c3 intersects with the straight line that links points d1, d2, d3. Therefore, the straight line that passes through points c2, d2 and links the middle point e1 of points c1, d3 and the middle point e2 of points c3, d1 is designated as the axis line 2. Using a toolmaker's microscope, the axis line indicator marks $A_1$, $A_2$ that indicate the abovementioned axis line 2 are applied using a router or the like in positions that are, for example, at a distance of 25 mm on both sides (i.e., points c2 and d2) of mark $A_0$ for indicating the reference position on the axis line 2.

The reason that the shaft of the lens meter is set to an arbitrary angular axis (e.g., 2 to 3 degrees) to apply the points c1, c2, c3, d1, d2, and d3 as described above is that the lens meter is sometimes set to a low accuracy from the perspective of workability for values that are near 180 degrees (0 degrees).

When the reference lens 1 is a progressive multifocal lens, a router or the like is used to apply a mark $B_0$, with the reference position being the center position between hidden marks 3, 4 or the position of a far-vision eyepoint 5 that is at a prescribed distance from the center position between the hidden marks, as shown in FIG. 5. Furthermore, a router or the like, for example, is used to apply at least two axis line indicator marks $B_1$, $B_2$ for indicating the axis line 2 of the reference lens 1 on both sides of mark $B_0$.

In other words, hidden marks 3 and 4 are provided at an arbitrary pitch so as to be visible on the convex lens surface 1A of the reference lens 1 composed of a progressive multifocal lens. The positions of the hidden marks 3, 4 are observed using a toolmaker's microscope (e.g., the toolmaker's microscope 31 shown in FIG. 1), and when the center position between the hidden marks 3, 4 is calculated and designated as the reference position, mark $B_0$ is applied in this position.

The straight line that links the hidden marks 3, 4 is then designated as the axis line 2, and axis line indicator marks $B_1$, $B_2$ are applied in positions that are, for example, at a distance of 25 mm on both sides of the mark $B_0$ on the axis line 2.

When the far-vision eyepoint 5 that is set to a position above and at a distance m (wherein m=2 to 4 mm, for example) from the center position between the hidden marks, the position of the far-vision eyepoint 5 is calculated using the abovementioned toolmaker's microscope, and mark $B_0$ is applied in this position using a router or the like. In this case, a straight line that passes through the abovementioned mark $B_0$ (far-vision eyepoint 5) and is parallel to the straight line linking the hidden marks 3, 4 is designated as the axis line 2, and axis line indicator marks $B_1$, $B_2$ for indicating the axis line 2 are applied in positions that are, for example, at a distance of 25 mm on both sides of the mark $B_0$ (far-vision eyepoint 5) on the axis line 2 by using a router or the like.

The reference symbol 6A in FIG. 5 indicates a far-vision portion for viewing distant objects, 6B indicates a near-vision portion for viewing close objects, and 6C indicates a progressive portion in which the frequency continuously changes.

When the reference lens 1 is a multifocal lens (a bifocal lens in the present embodiment), a mark $C_0$ is applied using a router or the like to indicate the center position (segment top 7A) of the upper edge 7D in the segment 7 (D-segment), or the position of a far-vision eyepoint 8 at a prescribed distance from the segment top 7A as the reference position, as shown in FIG. 6. Furthermore, a router or the like, for example, is used to apply at least two axis line indicator marks $C_1$, $C_2$ for indicating the axis line 2 of the reference lens 1 on both sides of mark $C_0$.

In other words, a multifocal lens (bifocal lens) is preferably mounted in an eyeglass frame so that the segments 7 are positioned substantially symmetrically. A multifocal lens must therefore be retained by the lens holder using the position of the segment 7 as the reference. Accordingly, when the reference lens 1 is a multifocal lens (bifocal lens), and the segment top 7A is used as the reference position, both end portions 7B, 7C of the segment 7 are observed using a toolmaker's microscope, the position of the segment top 7A on the upper edge 7D is calculated from the center coordinates of the end portions 7B, 7C, and a mark is applied using a router or the like. A straight line that passes through the segment top 7A and is parallel to the straight line 9 linking the end portions 7B, 7C of the segment 7 is calculated as the axis line 2, and axis line indicator marks $C_1$, $C_2$ for indicating the axis line 2 are applied in positions that are, for example, at a distance of 25 mm on both sides of the segment top 7A by using a router or the like.

When a far-vision eyepoint 8 positioned at a distance n1 above the segment top 7A and at a distance n2 to the outside (wherein n1=5 mm and n2=2.5 mm, for example) is designated as the reference position, the position of the far-vision eyepoint 8 is determined using the abovementioned toolmaker's microscope, and a mark $C_0$ is applied in this position by using a router or the like. In this case, a straight line that passes through the mark $C_0$ (far-vision eyepoint 8) and is parallel to the abovementioned straight line 9 is designated as the axis line 2, and axis line indicator marks $C_1$, $C_2$ for indicating the axis line 2 are applied in positions that are, for example, at a distance of 25 mm on both sides of the mark $C_0$ (far-vision eyepoint 8) on the axis line 2 by using a router or the like.

Figure 7A:
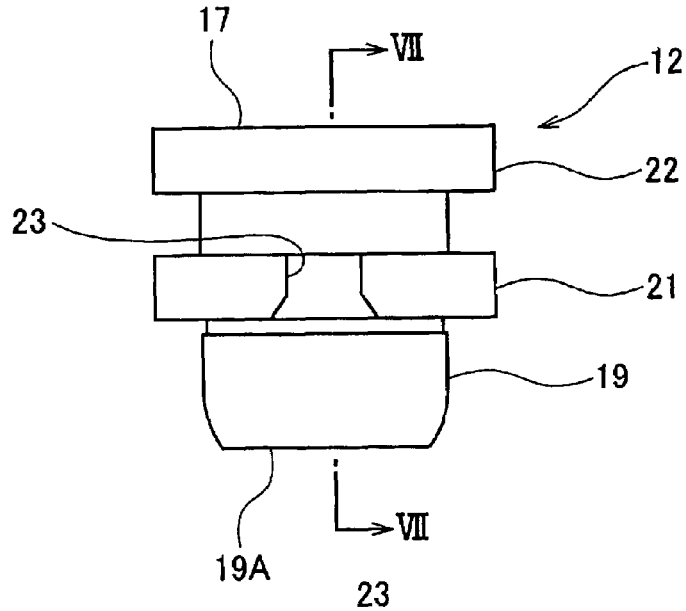
FIG. 7A is a front view.

After the marking step is performed as described above, the attachment step is performed. In the attachment step, a lens holder attachment apparatus (i.e., lens blocker apparatus) not shown in the drawings is used to attach a lens holder 12 to a convex lens surface 1A of a reference lens 1. The lens holder 12 used in the attachment step is tubular and made of metal (stainless steel), and has an adhesive pad 18 affixed to a lens retaining surface 17, as shown in FIG. 7. The adhesive pad 18 is bonded to the convex lens surface 1A of the reference lens 1, whereby the lens holder 12 is attached (blocked) to the convex lens surface 1A of the reference lens 1.

Figure 8A:
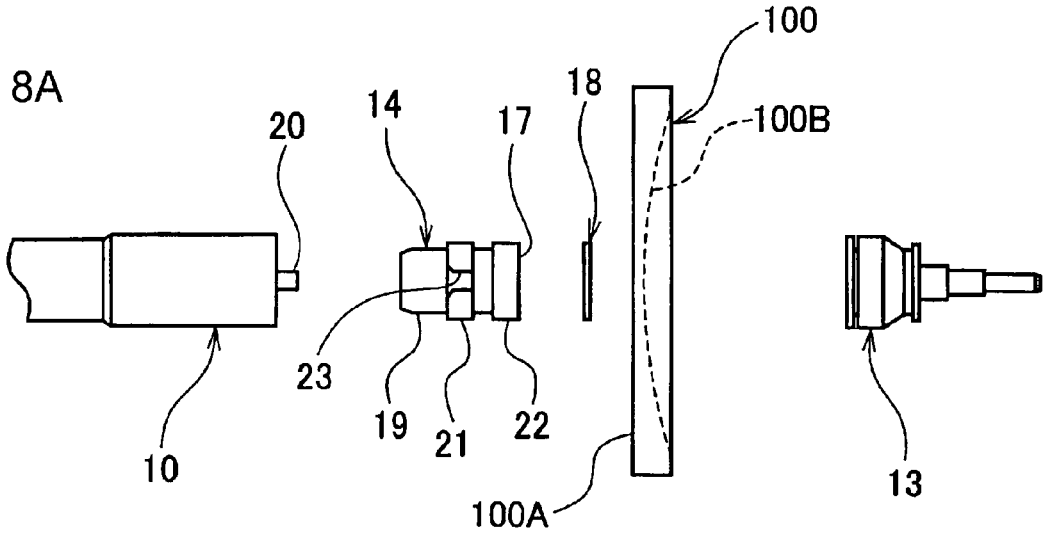
FIG. 8A is a bottom view showing the state before blocking is completed.
Figure 8B:
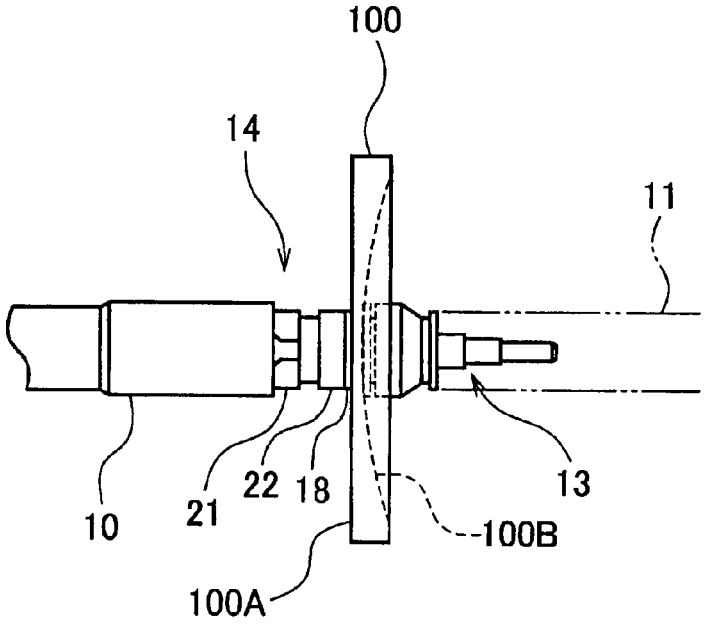
FIG. 8B is a bottom view showing the state after blocking is completed.

At such times as when an untreated eyeglass lens or other lens 100 is edged, the convex lens surface 100A and the concave lens surface 100B of the lens 100 are sandwiched and retained by a pair of lens retaining shafts 10, 11, as shown in FIG. 8. In this arrangement, a lens holder 14 is attached to the lens retaining shaft 10, a lens presser 13 is attached to the lens retaining shaft 11, and the lens 100 is held by the lens retaining shafts 10 and 11 through the use of the lens holder 14 and the lens presser 13.

As shown in FIG. 7, a fitting shaft 19 that is capable of fitting with the lens retaining shaft 10 and other components is provided to the lens holders 12, 14 at the proximal ends thereof, and a first flange 21 and a second flange 22 are provided to the distal ends. The second flange 22 is positioned at the distal ends of the lens holders 12, 14; and the end surface of the second flange 22 is formed by the lens retaining surface 17. The first flange 21 comes in contact with the end surfaces of the lens retaining shaft 10 and other components to perform a positioning function when the fitting shaft 19 is fitted into the lens retaining shaft 10 and other components. A groove 23 that fits with a protrusion 20 (FIG. 8) provided to the end surface of the lens retaining shaft 10 is formed in the first flange 21, and the lens holder 14 is rotated in integral fashion with the lens retaining shaft 10.

In the abovementioned lens holder 14, an identification bushing 27 (FIG. 7) is pressed into the fitting shaft 19 in order to identify multiple different types of lens holders that differ only with respect to the curvature radius of the lens retaining surface 17. In contrast, the identification bushing 27 is omitted from the lens holder 12, and a cavity-shaped hole 28 is formed therein. The cavity-shaped hole 28 is formed in the center position of the end surface of the fitting shaft 19 so as to pass through in the axis direction of the lens holder 12 from the end surface to the lens retaining surface 17, and the diameter dm of the cavity-shaped hole 28 is 10 mm, for example. Accordingly, the marks $A_0$, $B_0$, $C_0$ for indicating the reference positions on the convex lens surface 1A of the reference lens 1 are provided so as to be observable through the cavity-shaped hole 28 when the lens holder 12 is attached to the reference lens 1.

Figure 7B:
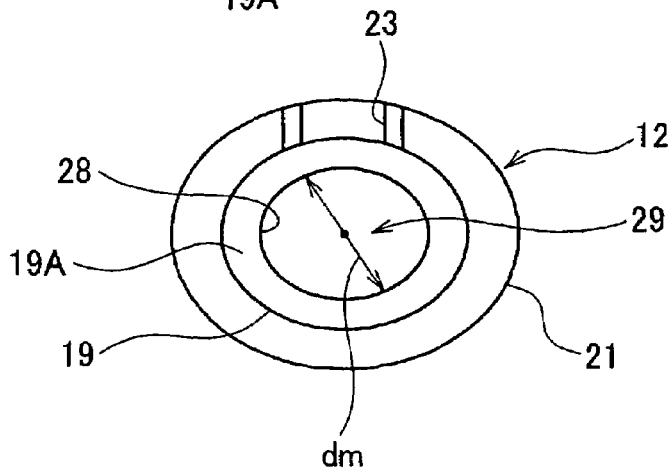
FIG. 7B is a bottom view.
Figure 7C:
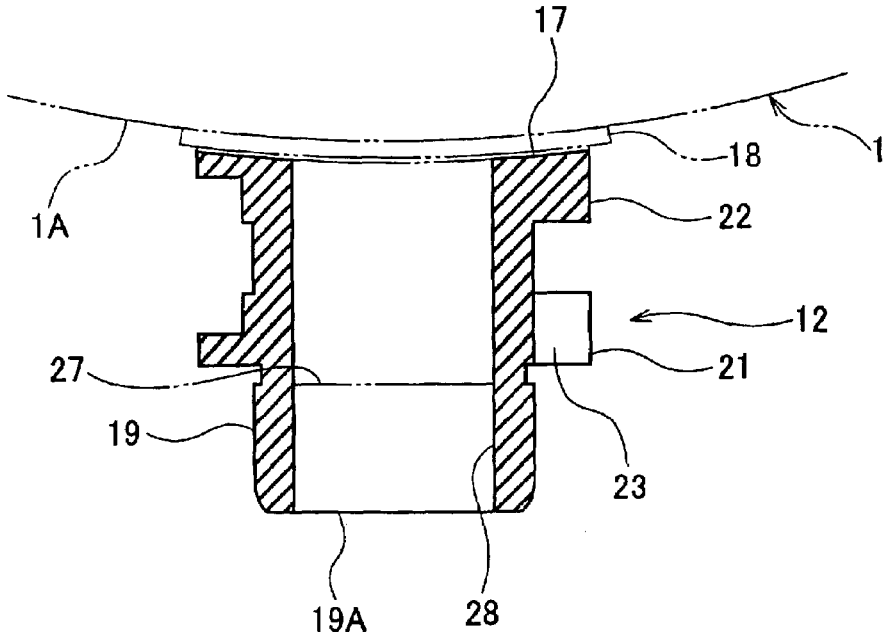
FIG. 7C is a sectional view along line VII-VII in FIG. 7A.

As shown in FIG. 7B, the geometric center 29 of the end surface 19A of the fitting shaft 19 of the lens holder 12 is positioned inside the abovementioned cavity-shaped hole 28. In this attachment step, the geometric center 29 of the lens holder 12 is set so as to match the marks $A_0$, $B_0$, $C_0$ for indicating the reference position of the reference lens 1, and the lens holder attachment apparatus is used to attach (block) the lens holder 12 to the convex lens surface 1A of the reference lens 1.

In the aforementioned setting step, the actual attachment position of the lens holder 12 when the lens holder 12 is attached to the reference lens 1 is set so as to coincide with the geometric center 29 of the fitting shaft 19 of the lens holder 12, and the geometric center 29 is set to the field-of-view center 30 of the field of view 25 (FIGS. 11 and 12) of the toolmaker's microscope 31 (FIG. 1). This step uses the centering fixture 32 and the lens attachment stage 33 shown in FIGS. 9 and 10.

Figure 9:
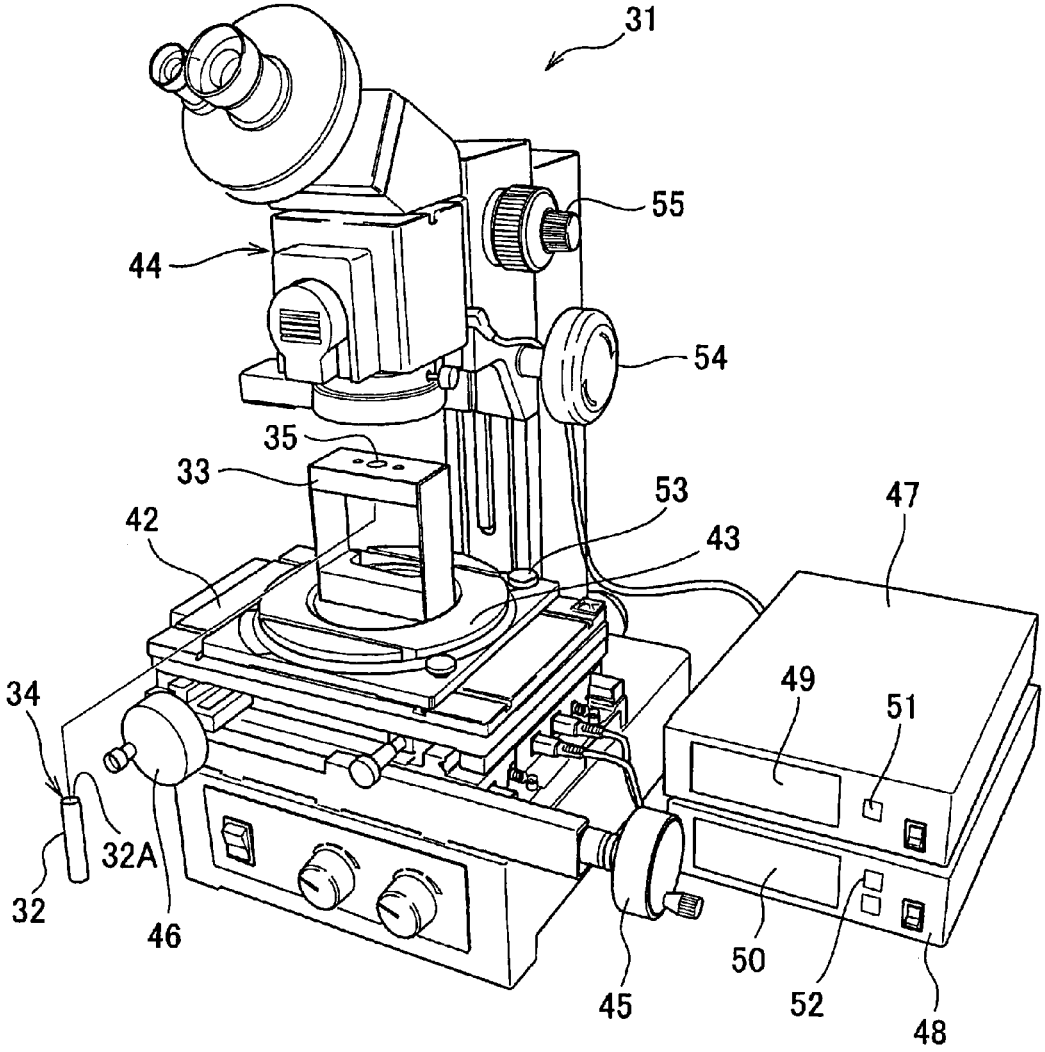
FIG. 9 is a perspective view showing a state in which a centering fixture is attached to the lens attachment stage in the system for verifying accuracy of lens holder attachment shown in FIG. 1.

As shown in FIG. 9, the centering fixture 32 is formed in a cylindrical shape whose external peripheral surface has the same outside diameter as the external peripheral surface of the fitting shaft 19 (FIG. 7) of the lens holder 12. A mark 34 (FIG. 11) for indicating the geometric center of the end surface 32A of the centering fixture 32 is provided so as to be visible on at least one end surface of the centering fixture 32. Consequently, when the centering fixture 32 is fitted into the first hole 35 (described hereinafter) of the lens attachment stage 33, the mark 34 of the centering fixture 32 is positioned so as to coincide with the geometric center 29 of the lens holder 12 in which the fitting shaft 19 is fitted into the first hole 35 of the lens attachment stage 33.

As shown in FIG. 3, the lens attachment stage 33 is formed so that leg parts 24 extend from both sides of a top part 39, and the first hole 35 is formed in the center position of the top part 39. Second holes 36, 37, 38 are also formed in the top part 39 in pairs on opposing sides of the first hole 35.

Figure 10B:
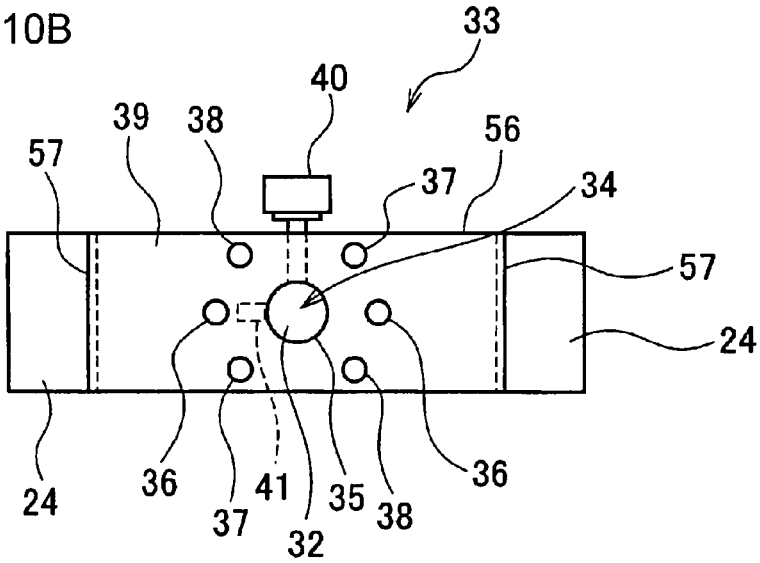
FIG. 10B is a plan view.
Figure 10A:
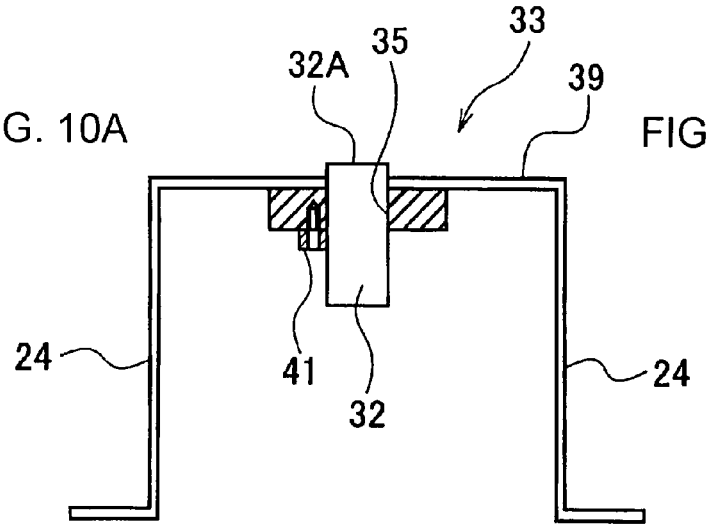
FIG. 10A is a front sectional view.
Figure 10C:
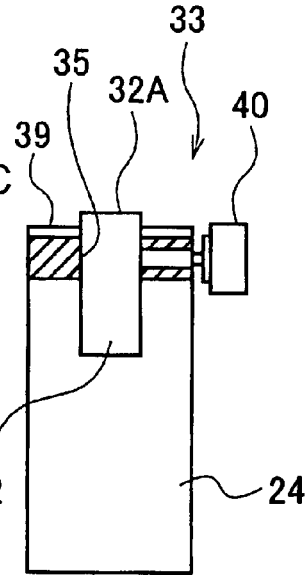
FIG. 10C is a lateral sectional view.

The first hole 35 is formed so as to have the same diameter as the outside diameter of the fitting shaft 19 of the lens holder 12 or as the outside diameter of the centering fixture 32, and the centering fixture 32 or the fitting shaft 19 of the lens holder 12 can be fitted in the first hole 35 as shown in FIG. 2 or FIG. 10. A fastening screw 40 is screwed into the top part 39 of the lens attachment stage 33. The distal end part of the fastening screw 40 is in contact with the external peripheral surface of the centering fixture 32 or with the fitting shaft 19 of the lens holder 12 fitted into the first hole 35, and retains the lens holder 12 or the centering fixture 32 against the top part 39 of the lens attachment stage 33. The reference lens 1 is thereby mounted (FIG. 2) on the lens attachment stage 33 via the lens holder 12 attached to the convex lens surface 1A. The toolmaker's microscope 31 is then used to observe the marks $A_0$, $B_0$, $C_0$ for indicating the reference position of the convex lens surface 1A of the reference lens 1 through the cavity-shaped hole 28 of the lens holder 12, which is retained in the first hole 35 of the lens attachment stage 33.

A key 41 is provided to the bottom surface of the top part 39 of the lens attachment stage 33. The key 41 is fitted into the groove 23 (FIG. 7) of the lens holder 12 when the fitting shaft 19 of the lens holder 12 is fitted into the first hole 35 in the manner described above. There are usually cases in which the reference lens 1 is attached (blocked) to the lens holder 12 in a 180-degree block in which the direction of the axis line 2 coincides with the groove 23 of the lens holder 12, or in a 45-degree block in which the axis line 2 is at a 45 degree angle in relation to the groove 23 of the lens holder 12.

The pair of second holes 36 are formed in positions that correspond to the axis line indicator marks $A_1$, $A_2$, $B_1$, $B_2$, $C_1$, $C_2$ of the reference lens 1 in a state in which the key 41 of the lens attachment stage 33 is fitted in the groove 23 of the lens holder 12 when the reference lens 1 is attached in a 180-degree blocking position to the lens holder 12. Accordingly, the axis line indicator marks $A_1$, $A_2$, $B_1$, $B_2$, $C_1$, $C_2$ on the convex lens surface 1A are viewed through the second holes 36 by using the toolmaker's microscope 31. The pairs of second holes 37, 38 are also formed in positions that correspond to the axis line indicator marks $A_1$, $A_2$, $B_1$, $B_2$, $C_1$, $C_2$ of the reference lens 1 in a state in which the key 41 of the lens attachment stage 33 is fitted in the groove 23 of the lens holder 12 when the reference lens 1 is attached in a 45-degree blocking position to the lens holder 12. Accordingly, the axis line indicator marks $A_1$, $A_2$, $B_1$, $B_2$, $C_1$, $C_2$ on the convex lens surface 1A are viewed through the pairs of second holes 37, 38 by using the toolmaker's microscope 31.

As shown in FIGS. 1 and 9, the toolmaker's microscope 31 is configured so that a turntable 43 is mounted on an XY stage 42 as a measurement stage, and a lens unit 44 provided with an objective lens and an eyepiece lens (not shown) is attached so as to be able to raise and lower on the XY stage 42. The XY stage 42 can be moved in the X and Y directions in the horizontal plane by the operation of an X-movement knob 45 and a Y-movement knob 46. The amount of movement of the XY stage 42 in the X direction is indicated in an indication window 49 of an X-movement amount display 47. The amount of movement of the XY stage 42 in the Y direction is indicated in an indication window 50 of a Y-movement amount display 48. The values indicating the amounts of movement in the indication windows 49, 50 are set to zero through the operation of reset buttons 51, 52 on the X-movement amount display 47 and the Y-movement amount display 48, respectively.

The turntable 43 is configured so as to be capable of rotating in relation to the XY stage 42 when a stopper 53 provided to the XY stage 42 is released to unfix the XY stage 42. The abovementioned lens attachment stage 33 is mounted on the turntable 43. The lens unit 44 is also raised and lowered with respect to the XY stage 42 and the turntable 43 to adjust focus through the operation of a Z-movement knob 54 and a fine adjustment knob 55.

In the setting step, the position in which the lens holder 12 is actually attached to the reference lens 1 is set to the geometric center 29 in the end surface 19A of the fitting shaft 19 of the lens holder 12, and the centering fixture 32 and the lens attachment stage 33 configured as described above are used to set the geometric center 29 of the lens holder 12 to the field-of-view center 30 (FIGS. 11 and 12) of the field of view 25 of the toolmaker's microscope 31, as shown in FIGS. 1 and 2.

In other words, as shown in FIG. 10, the centering fixture 32 is first fitted into the first hole 35 of the lens attachment stage 33, the fastening screw 40 is operated, and the centering fixture 32 is retained in the lens attachment stage 33. The lens attachment stage 33 with which the centering fixture 32 is integrated is mounted on the turntable 43 of the toolmaker's microscope 31, as shown in FIG. 9. At this time, a verification is made as to whether the X-direction end surface 56 and the Y-direction end surface 57 (FIG. 10) that intersect each other in the top part 39 of the lens attachment stage 33 are parallel to an X-reference line 58 and a Y-reference line 59 in the field of view 25 of the toolmaker's microscope 31 shown in FIG. 11. Furthermore, a verification is made as to whether the abovementioned X-direction end surface 56 moves parallel to the X-reference line 58 when the X-movement knob 45 of the toolmaker's microscope 31 is operated, and whether the Y-direction end surface 57 moves parallel to the Y-reference line 59 when the Y-movement knob 46 of the toolmaker's microscope 31 is operated. The turntable 43 is rotationally adjusted so that the abovementioned parallel movements are satisfied, and after this adjustment, the turntable 43 is fixed using the stopper 53.

Figure 11:
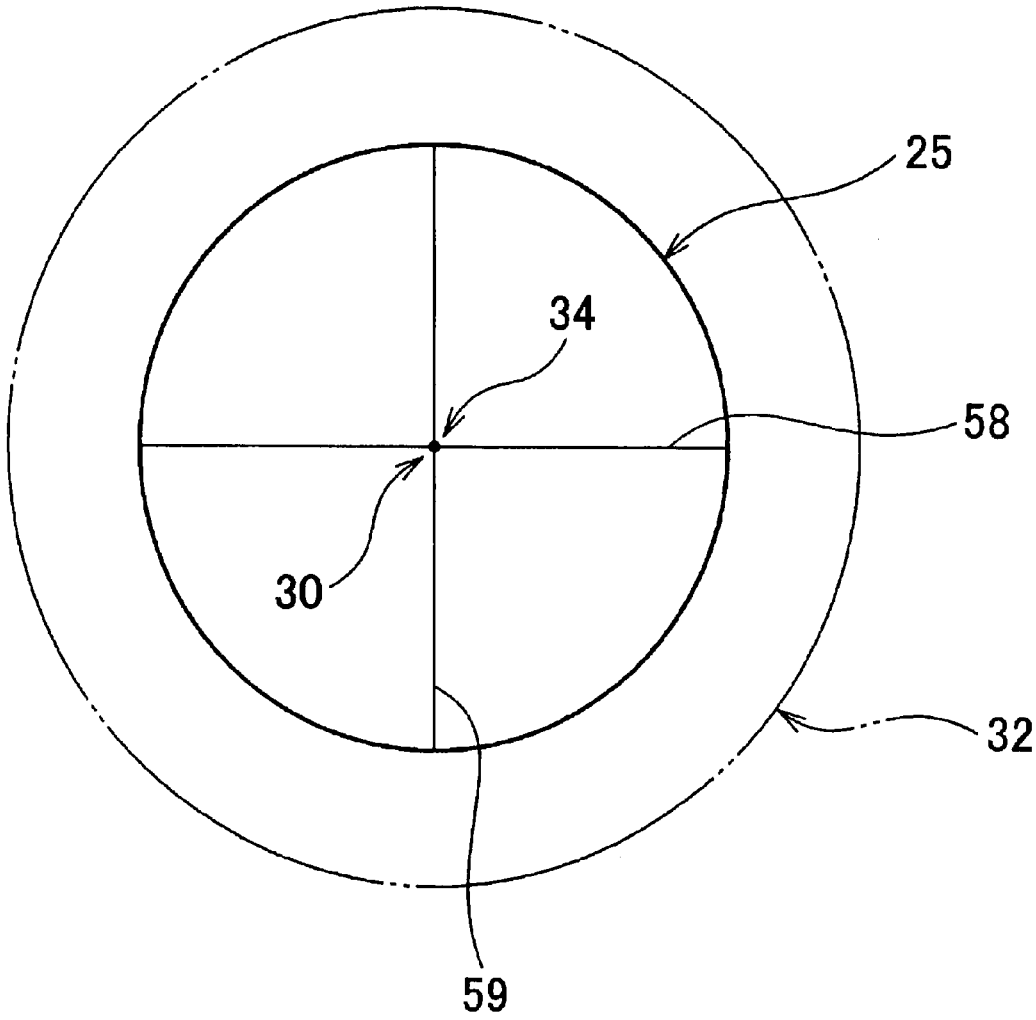
FIG. 11 is a diagram showing the field of view of the toolmaker's microscope in the system for verifying accuracy of lens holder attachment shown in FIG. 9, in a state in which the center of the field of view coincides with the geometric center of the centering fixture.

The X-movement knob 45 and the Y-movement knob 46 of the toolmaker's microscope 31 are then operated so that the field-of-view center 30 (i.e., intersection point of the X-reference line 58 and the Y-reference line 59) of the field of view 25 of the toolmaker's microscope 31 coincides with the mark 34 for indicating the geometric center of the end surface 32A of the centering fixture 32, as shown in FIG. 11. In this state, the reset buttons 51, 52 of the X-movement amount display 47 and the Y-movement amount display 48 are operated to set the values displayed in the indication windows 49, 50 to zero. The centering fixture 32 is then detached from the lens attachment stage 33.

In the state in which the centering fixture 32 and the fitting shaft 19 of the lens holder 12 are fitted in the first hole 35 of the lens attachment stage 33 as shown in FIGS. 2 and 10, the geometric center (mark 34) of the end surface 32A of the centering fixture 32 coincides with the geometric center 29 of the end surface 19A in the fitting shaft 19 of the lens holder 12. Accordingly, when the fitting shaft 19 of the lens holder 12 is fitted into and retained by the first hole 35 of the lens attachment stage 33 according to the procedure described above, the field-of-view center 30 of the toolmaker's microscope 31 coincides with the geometric center 29 of the end surface 19A in the fitting shaft 19 of the lens holder 12.

In the comparison step, a comparison is made between the position in which the lens holder 12 is actually attached and the marks $A_0$, $B_0$, $C_0$ applied in the reference position of the reference lens 1, and the accuracy of the attachment position of the lens holder 12 on the convex lens surface 1A of the reference lens 1 is verified.

Specifically, as shown in FIGS. 1 and 2, the fitting shaft 19 of the lens holder 12 attached to the convex lens surface 1A of the reference lens 1 is first fitted into and retained by the first hole 35 of the lens attachment stage 33 mounted on the turntable 43 of the toolmaker's microscope 31. The toolmaker's microscope 31 is then used to observe the marks $A_0$, $B_0$, $C_0$, which indicate the reference position, through the cavity-shaped hole 28 of the lens holder 12 from the direction of the convex lens surface 1A of the reference lens 1.

In the attachment step, the lens holder 12 is attached to the convex lens surface 1A of the reference lens 1 so that the geometric center 29 of the end surface 19A in the fitting shaft 19 of the lens holder 12 coincides with the reference position of the reference lens 1. In the setting step of the lens holder 12, the geometric center 29 is set so as to coincide with the field-of-view center 30 of the toolmaker's microscope 31. Consequently, the accuracy with which the lens holder 12 is attached on the convex lens surface 1A of the reference lens 1 is verified by comparing the field-of-view center 30 of the field of view 25 of the toolmaker's microscope 31 with the observed marks $A_0$, $B_0$, $C_0$ that indicate the reference position of the reference lens 1, as shown in FIG. 12.

The amount of misalignment between the geometric center 29 in the fitting shaft 19 of the lens holder 12, and the marks $A_0$, $B_0$, $C_0$ for indicating the reference position of the reference lens 1 is calculated by operating the X-movement knob 45 and the Y-movement knob 46 of the toolmaker's microscope 31 to align the marks $A_0$, $B_0$, $C_0$ with the field-of-view center 30 of the toolmaker's microscope 31, and then verifying the amount of movement of the XY stage 42 by using the X-movement amount display 47 and the Y-movement amount display 48. This amount of misalignment is reflected by the lens holder attachment apparatus (not shown) in which the lens holder 12 is attached to the convex lens surface 1A of the reference lens 1, and the attachment accuracy of the lens holder attachment apparatus is satisfactorily maintained.

In the mark observation step, the attachment accuracy about the axis of the lens holder 12 is verified by observing the axis line indicator marks $A_1$, $A_2$, $B_1$, $B_2$, $C_1$, $C_2$ that indicate the axis line 2 of the reference lens 1.

Specifically, in a state in which the reference lens 1 is attached via the lens holder 12 to the lens attachment stage 33 mounted on the turntable 43 of the toolmaker's microscope 31 as shown in FIGS. 1, 2, and 13, the toolmaker's microscope 31 is used to observe the axis line indicator marks $A_1$, $A_2$, $B_1$, $B_2$, $C_1$, $C_2$ of the reference lens 1 from the direction of the convex lens surface 1A of the reference lens 1 through the pair of second holes 36, 37 or 38 in the lens attachment stage 33. The observation is performed using the pair of second holes 36 when the lens holder 12 is in the aforementioned 180-degree block attachment to the convex lens surface 1A of the reference lens 1, and the observation is performed using the pair of second holes 37 or 38 when the lens holder 12 is in the aforementioned 45-degree block attachment to the convex lens surface 1A of the reference lens 1.

For example, when the lens holder 12 is in the aforementioned 180-degree block attachment to the convex lens surface 1A of the reference lens 1, the X-movement knob 45 is operated and the pair of second holes 36 is used to observe the convex lens surface 1A from the direction of the convex lens surface 1A. The attachment accuracy about the axis of the lens holder 12 is verified using the amount of misalignment between the field-of-view center 30 and the positions of the axis line indicator marks $A_1$, $B_1$, $C_1$ when observed from one of the second holes 36, and is verified using the amount of misalignment between the field-of-view center 30 and the positions of the axis line indicator marks $A_2$, $B_2$, $C_2$ when observed from the other second hole 36. The amounts of misalignment are reflected by the lens holder attachment apparatus in which the lens holder 12 is attached to the convex lens surface 1A of the reference lens 1, and the attachment accuracy of the lens holder attachment apparatus is satisfactorily maintained.

In the lens processing system for processing an untreated eyeglass lens or other lens 100, the system for verifying accuracy of lens holder attachment configured as described above is used to first verify the attachment accuracy of the lens holder 12 in the lens holder attachment apparatus (lens blocker apparatus). When the attachment accuracy is satisfactory, the lens holder attachment apparatus is used to perform the lens holder attachment step for attaching the lens holder 14 (FIG. 8) to the convex lens surface 100A of the lens 100. At this time, the lens holder 14 is attached (blocked) to the lens 100 so that the geometric center 29 of the end surface 19A in the fitting shaft 19 of the lens holder 14 coincides with the center processing position (which corresponds to the reference position of the reference lens 1) of the lens 100.

Figure 14:
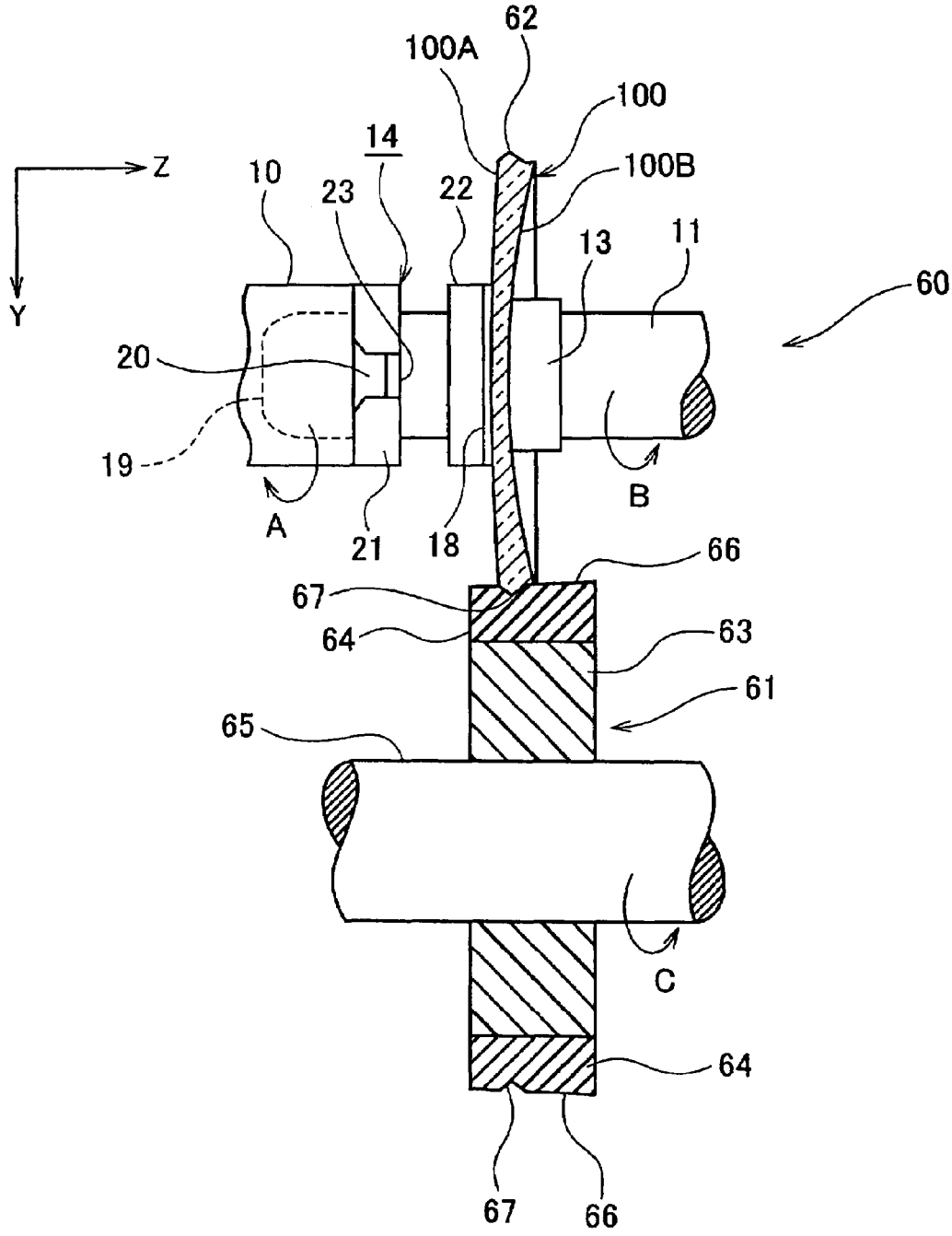
FIG. 14 is a plan sectional view showing the edging process of an untreated eyeglass lens after blocking is completed in FIG. 8.

A grinding/cutting step is performed for grinding and/or cutting the lens 100 to which the lens holder 14 is attached in this manner. This grinding/cutting step involves edging designed to allow the lens 100 to be fitted into eyeglass frames, for example. In the example of the edging apparatus 60 for performing the abovementioned edging as shown in FIG. 14, the external periphery of the lens 100 is cut by a grindstone or other cutter (V-groove cutter 61 in the present embodiment), and a V-shaped protrusion referred to as a V groove 62 is formed on the external periphery of the lens.

In this edging apparatus 60, the lens holder 14 into which the lens 100 is installed is attached to the lens retaining shaft 10 by fitting the fitting shaft 19 into the lens retaining shaft 10 and bringing the first flange 21 into contact with the distal end of the lens retaining shaft 10. At this time, the protrusion 20 of the lens retaining shaft 10 is fitted in the groove 23 in the first flange 21 of the lens holder 14, and the lens holder 14 is prevented from rotating with respect to the lens retaining shaft 10. The other lens retaining shaft 11 positioned on the opposite side of the lens 100 from the lens retaining shaft 10 is positioned so that the shaft center thereof coincides with that of the lens retaining shaft 10. The lens presser 13 disposed at the distal end of the lens retaining shaft 11 presses against the concave lens surface 100B of the lens 100. Accordingly, the lens 100 is held between the lens holder 14 and the lens presser 13, and is retained by the lens retaining shafts 10 and 11.

The lens retaining shafts 10 and 11 are rotated in tandem in the direction of the arrows A, B during edging of the lens 100, while being controlled so as to move in the direction (Y direction) orthogonal to the axis center on the basis of lens frame shape data.

The abovementioned V-groove cutter 61 is a milling cutter formed by a cutter body 63 and four blades 64 that are fixed to the external peripheral part of the cutter body 63, and the cutter body 63 is attached to a rotating shaft 65 that is parallel to the lens retaining shafts 10 and 11. V-shaped grooves 67 are formed in the center positions in the width direction of the blade tips 66 of the blades 64. In cases in which a V groove 62 is not formed on the external periphery of the lens 100, a flat-cutting cutter is used instead of the V-groove cutter 61.

When the lens 100 is machined by the V-groove cutter 61, a drive apparatus (not shown) is actuated to rotate the V-groove cutter 61 in the direction of the arrow C. At the same time as the lens 100 is being rotated in the same direction as the V-groove cutter 61, the lens 100 is moved in the Y direction in accordance with the abovementioned processing program, and the external peripheral surface of the lens 100 is brought into contact with the V-groove cutter 61. The blade tips 66 on the blades 64 of the V-groove cutter 61 then cut into the external periphery of the lens 100, a prescribed amount of the external periphery of the lens 100 is cut away, and a lens 100 is ultimately manufactured that has a profile that substantially matches the lens frame shape and has a V groove 62 on the peripheral surface.

The following effects (1) through (4) are demonstrated by the abovementioned embodiments configured as described above.

(1) According to the system for verifying accuracy of lens holder attachment, the position in which the lens holder 12 is actually attached to the convex lens surface 1A of the reference lens 1 (position of the geometric center 29 of the end surface 19A in the fitting shaft 19 of the lens holder 12) is compared with the marks $A_0$, $B_0$, $C_0$ applied on the convex lens surface 1A of the reference lens 1 in the reference position in which attachment of the lens holder 12 is anticipated. This comparison is performed by using the toolmaker's microscope 31 to observe the abovementioned marks $A_0$, $B_0$, $C_0$ through the cavity-shaped hole 28 of the lens holder 12 from the direction of the convex lens surface 1A of the reference lens 1. When the attachment position of the lens holder 12 attached to the convex lens surface 1A using the lens holder attachment apparatus is observed from the direction of the concave lens surface 1B of the reference lens 1, the observation is affected by the optical effects of the reference lens 1. However, by observing from the direction of the convex lens surface 1A as described above, the attachment accuracy in the convex lens surface 1A of the lens holder 12 can be precisely verified without the observation being affected by the optical effects of the reference lens 1.

(2) According to the system for verifying accuracy of lens holder attachment, the toolmaker's microscope 31 is used to observe the axis line indicator marks $A_1$, $A_2$, $B_1$, $B_2$, $C_1$, $C_2$, which indicate the axis line 2 provided on the convex lens surface 1A of the reference lens 1, from the direction of the convex lens surface 1A of the reference lens 1, whereby it is possible to verify the attachment about the axis of the lens holder 12 attached to the reference lens 1. Accordingly, the attachment accuracy about the axis can be precisely verified in this case as well without the observation being affected by the optical effects of the reference lens 1.

(3) According to the system for verifying accuracy of lens holder attachment, the lens holder 12 is retained in the first hole 35 of the lens attachment stage 33, and the marks $A_0$, $B_0$, $C_0$ for indicating the reference position, or the axis line indicator marks $A_1$, $A_2$, $B_1$, $B_2$, $C_1$, $C_2$ for indicating the axis line 2 in the convex lens surface 1A of the reference lens 1 attached to the lens holder 12 can be observed from the direction of the convex lens surface 1A by using the toolmaker's microscope 31. Therefore, these indications or marks can be precisely observed without the observation being affected by the optical effects of the reference lens 1.

(4) According to the lens processing system for processing an untreated-eyeglass lens or other lens 100, the system for verifying accuracy of lens holder attachment is used to attach the lens holder 14 to an untreated eyeglass lens 100 by using the lens holder attachment apparatus, and to edge the untreated eyeglass lens 100 by using the edging apparatus 60 when the attachment accuracy of the lens holder 12 in the lens holder attachment apparatus is satisfactory. Therefore, since the untreated eyeglass lens 100 to which the lens holder is attached with low accuracy is not subjected to edging, it is possible to prevent processing defects or reduced processing accuracy from occurring due to edging such an untreated eyeglass lens.

The present invention was described based on the abovementioned embodiments, but the present invention is in no way limited by the embodiments.

What is claimed is:

1. A system for verifying accuracy of lens holder attachment, comprising:

a marking step for applying a mark in advance in a reference position in which attachment of a lens holder is anticipated on a convex lens surface of a reference lens when the lens holder is attached to the reference lens;

an attachment step for attaching said lens holder to the convex lens surface of said reference lens by using a lens holder attachment apparatus; and a comparison step for comparing a position in which the lens holder is actually attached and a reference position in which said mark is applied on said reference lens; wherein a cavity-shaped hole is formed in said lens holder so that a position of said mark on said reference lens can be observed when the lens holder is attached to said reference lens; and a toolmaker's microscope is used in the comparison step to observe said mark through said cavity-shaped hole in said lens holder from a direction of said convex lens surface of said reference lens, an actual attachment position of said lens holder is compared to said reference position of said reference lens, and an attachment accuracy of said lens holder is verified.

2. The system for verifying accuracy of lens holder attachment according to claim 1, further comprising a setting step for setting a geometric center of the lens holder so as to coincide with an actual attachment position of the lens holder in the comparison step when the lens holder is attached to said reference lens.

3. The system for verifying accuracy of lens holder attachment according to claim 2, wherein a lens attachment stage is mounted on a measurement stage of a toolmaker's microscope in the setting step so that a geometric center position of a lens holder coincides with an actual attachment position in the comparison step; and the lens attachment stage is provided with a first hole for retaining said lens holder.

4. The system for verifying accuracy of lens holder attachment according to claim 3, wherein said setting step comprises fitting a fixture having a geometric center and an outside diameter that is the same as an outside diameter of said lens holder into said first hole so that a geometric center position of a lens holder retained in the first hole of a lens attachment stage coincides with a center of a field of view of the toolmaker's microscope; and adjusting the toolmaker's microscope so that a geometric center position of the fixture coincides with a center of a field of view of said toolmaker's microscope.

5. The system for verifying accuracy of lens holder attachment according to claim 3, wherein said marking step comprises marking an optical center position of a monofocal lens as a reference position when the reference lens is a monofocal lens.

6. The system for verifying accuracy of lens holder attachment according to claim 3, wherein said marking step comprises marking a center position of two hidden marks on a progressive multifocal lens, or an eyepoint position at a prescribed distance from a center position of the hidden marks as a reference position when the reference lens is a progressive multifocal lens.

7. The system for verifying accuracy of lens holder attachment according to claim 3, wherein said marking step comprises marking a segment top position of a multifocal lens, or an eyepoint position at a prescribed distance from the segment top position as a reference position when the reference lens is a multifocal lens.

8. The system for verifying accuracy of lens holder attachment according to claim 2, wherein said setting step comprises fitting a fixture having a geometric center and an outside diameter that is the same as an outside diameter of said lens holder into said first hole so that a geometric center position of a lens holder retained in the first hole of a lens attachment stage coincides with a center of a field of view of the toolmaker's microscope; and adjusting the toolmaker's microscope so that a geometric center position of the fixture coincides with a center of a field of view of said toolmaker's microscope.

9. The system for verifying accuracy of lens holder attachment according to claim 8, wherein said marking step comprises marking an optical center position of a monofocal lens as a reference position when the reference lens is a monofocal lens.

10. The system for verifying accuracy of lens holder attachment according to claim 8, wherein said marking step comprises marking a center position of two hidden marks on a progressive multifocal lens, or an eyepoint position at a prescribed distance from a center position of the hidden marks as a reference position when the reference lens is a progressive multifocal lens.

11. The system for verifying accuracy of lens holder attachment according to claim 8, wherein said marking step comprises marking a segment top position of a multifocal lens, or an eyepoint position at a prescribed distance from the segment top position as a reference position when the reference lens is a multifocal lens.

12. The system for verifying accuracy of lens holder attachment according to claim 2, wherein said marking step comprises marking an optical center position of a monofocal lens as a reference position when the reference lens is a monofocal lens.

13. The system for verifying accuracy of lens holder attachment according to claim 2, wherein said marking step comprises marking a center position of two hidden marks on a progressive multifocal lens, or an eyepoint position at a prescribed distance from a center position of the hidden marks as a reference position when the reference lens is a progressive multifocal lens.

14. The system for verifying accuracy of lens holder attachment according to claim 2, wherein said marking step comprises marking a segment top position of a multifocal lens, or an eyepoint position at a prescribed distance from the segment top position as a reference position when the reference lens is a multifocal lens.

15. The system for verifying accuracy of lens holder attachment according to claim 1, wherein said marking step comprises marking an optical center position of a monofocal lens as a reference position when the reference lens is a monofocal lens.

16. The system for verifying accuracy of lens holder attachment according to claim 1, wherein said marking step comprises marking a center position of two hidden marks on a progressive multifocal lens, or an eyepoint position at a prescribed distance from a center position of the hidden marks as a reference position when the reference lens is a progressive multifocal lens.

17. The system for verifying accuracy of lens holder attachment according to claim 1, wherein said marking step comprises marking a segment top position of a multifocal lens, or an eyepoint position at a prescribed distance from the segment top position as a reference position when the reference lens is a multifocal lens.

18. The system for verifying accuracy of lens holder attachment according to claim 1, further comprising a mark observation step for applying at least two marks for indicating an axis line of the reference lens on both sides of a reference position in a convex lens surface of said reference lens, and observing said marks from a direction of said convex lens surface by using a toolmaker's microscope to verify an attachment accuracy about an axis of a lens holder attached to said convex lens surface of said reference lens.

19. A lens processing system wherein the system for verifying accuracy of lens holder attachment according to claim 1 is used to perform a lens holder attachment step for attaching a lens holder to an untreated eyeglass lens by using said lens holder attachment apparatus, and a grinding/cutting step for performing at least one of grinding and cutting of the untreated eyeglass lens after an attachment accuracy of the lens holder in the lens holder attachment apparatus is verified and the attachment accuracy is satisfactory.

20. A lens attachment stage for attaching said reference lens via a lens holder attached to a convex lens surface of a reference lens; said lens attachment stage comprising:

a first hole designed to retain the lens holder and provided with the same diameter as an outside diameter of said lens holder; and at least two second holes provided in positions that correspond to marks applied so as to indicate an axis line of said reference lens; wherein said convex lens surface of said reference lens can be observed by a toolmaker's microscope using a lens holder retained by said first hole.

* * * * *